US009880487B2

(12) United States Patent
Kouzaki et al.

(10) Patent No.: US 9,880,487 B2
(45) Date of Patent: Jan. 30, 2018

(54) IMAGE FORMING APPARATUS, METHOD FOR CONTROLLING IMAGE FORMING APPARATUS, AND PROGRAM FOR CONTROLLING IMAGE FORMING APPARATUS

(71) Applicant: Konica Minolta, Inc., Chiyoda-ku, Tokyo (JP)

(72) Inventors: Masahiro Kouzaki, Toyohashi (JP); Munenori Nakano, Toyokawa (JP); Hironori Akashi, Okazaki (JP); Kenji Tsuru, Toyokawa (JP); Yoshinori Tsutsumi, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/373,064

(22) Filed: Dec. 8, 2016

(65) Prior Publication Data

US 2017/0168411 A1 Jun. 15, 2017

(30) Foreign Application Priority Data

Dec. 11, 2015 (JP) ..... 2015-242019

(51) Int. Cl.
*G03G 15/02* (2006.01)

(52) U.S. Cl.
CPC ..... *G03G 15/0266* (2013.01); *G03G 15/0216* (2013.01); *G03G 2215/021* (2013.01)

(58) Field of Classification Search
CPC ..... G03G 15/0208; G03G 15/0216; G03G 15/0266; G03G 2215/02; G03G 2215/021
See application file for complete search history.

(56) References Cited

U.S. PATENT DOCUMENTS 5,576,807 A * 11/1996 Osawa ..... G03G 15/0216 361/225
5,596,393 A * 1/1997 Kobayashi ..... G03G 15/0105 361/225

(Continued)

FOREIGN PATENT DOCUMENTS

JP 06242663 A * 9/1994
JP 2005309378 A * 11/2005

(Continued)

*Primary Examiner* — Carla Therrien
(74) *Attorney, Agent, or Firm* — Buchanan Ingersoll & Rooney PC

(57) ABSTRACT

An image forming apparatus for electrifying a surface of a photoreceptor with the use of an electrification member includes: a first output unit configured to output a first AC voltage; a second output unit configured to output a second AC voltage having the same frequency as a frequency of the first AC voltage and having a phase different from a phase of the first AC voltage; a superimposition unit configured to superimpose, on a DC component, an AC component containing at least one of the first AC voltage and the second AC voltage; and an application unit configured to apply a voltage that has been subjected to superimposition by the superimposition unit to the electrification member, wherein the superimposition unit changes the AC component to be superimposed on the DC component at a predetermined timing.

21 Claims, 11 Drawing Sheets

(56) References Cited

U.S. PATENT DOCUMENTS

| | | | | |
|---|---|---|---|---|
| 6,067,426 | A * | 5/2000 | Kawakami | G03G 15/0216 399/175 |
| 2008/0118258 | A1 * | 5/2008 | Inoue | G03G 15/0216 399/50 |

FOREIGN PATENT DOCUMENTS

| | | | | |
|---|---|---|---|---|
| JP | 2006189721 | A | * | 7/2006 |
| JP | 2008-152233 | A | | 7/2008 |

* cited by examiner

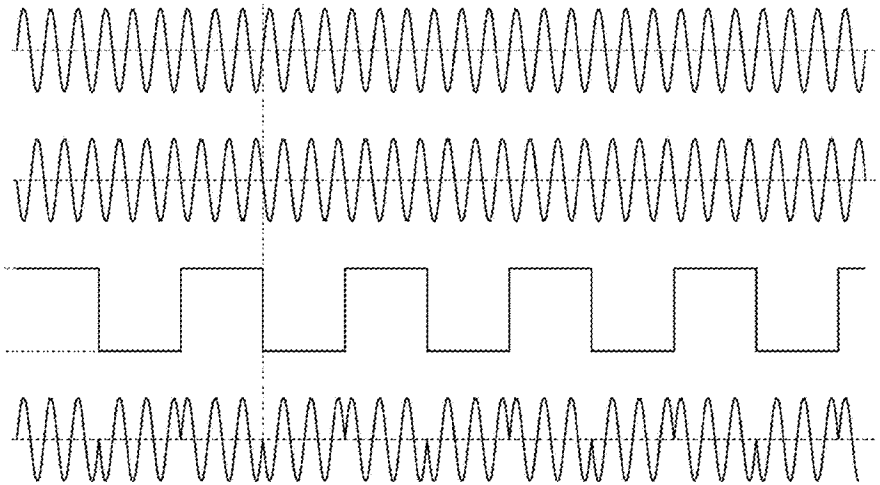
FIG. 3A FIRST AC VOLTAGE (NORMAL PHASE)
FIG. 3B SECOND AC VOLTAGE (OPPOSITE PHASE)
FIG. 3C AC OUTPUT CONTROL SIGNAL
FIG. 3D AC COMPONENT OUTPUT BY AC POWER SUPPLY UNIT

FIG. 4

| TOTAL NUMBER OF WAVES IN SINGLE AC VOLTAGE PERIOD GENERATED FROM START OF ELECTRIFICATION | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| AC COMPONENT SUPERIMPOSED ON DC COMPONENT | FIRST AC VOLTAGE (NORMAL PHASE) | | | | | | SECOND AC VOLTAGE (OPPOSITE PHASE) | | | | | | | FIRST AC VOLTAGE (NORMAL PHASE) | | | | | | SECOND AC VOLTAGE (OPPOSITE PHASE) | | | | | FIRST AC VOLTAGE (NORMAL PHASE) | | | | | | SECOND AC VOLTAGE (OPPOSITE PHASE) | | | | | |
| NUMBER OF WAVES IN SINGLE AC VOLTAGE PERIOD INDICATING INTERVAL | 6 | | | | | | 7 | | | | | | | 6 | | | | | | 4 | | | | | 5 | | | | | | 8 | | | | | |

FIG. 8

| TOTAL NUMBER OF WAVES IN SINGLE DEVELOPING VOLTAGE PERIOD GENERATED FROM START OF ELECTRIFICATION | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 |
|---|---|---|---|---|---|---|---|---|---|---|---|---|---|---|---|---|---|---|---|---|---|---|---|---|---|---|---|---|---|---|---|---|---|---|---|---|
| AC COMPONENT SUPERIMPOSED ON DC COMPONENT | FIRST AC VOLTAGE (NORMAL PHASE) | | | | | | SECOND AC VOLTAGE (OPPOSITE PHASE) | | | | | | FIRST AC VOLTAGE (NORMAL PHASE) | | | | | | SECOND AC VOLTAGE (OPPOSITE PHASE) | | | | FIRST AC VOLTAGE (NORMAL PHASE) | | | | SECOND AC VOLTAGE (OPPOSITE PHASE) | | | | | | | |
| NUMBER OF WAVES IN SINGLE DEVELOPING VOLTAGE PERIOD INDICATING INTERVAL | 6 | | | | | | 7 | | | | | | 6 | | | | | | 4 | | | | 5 | | | | 8 | | | | | | | |

FIG. 9

■ INTERFERENCE PITCH (mm)

| SYSTEM SPEED Vsys [mm/sec] | | | 240 | | | | | |
|---|---|---|---|---|---|---|---|---|
| ELECTRIFICATION FREQUENCY Fc [Hz] | | | 2400 | 2000 | 1714 | 1500 | 1333 | 1200 |
| ELECTRIFICATION SPATIAL FREQUENCY Fp [lp/mm] | | | 10.0 | 8.3 | 7.1 | 6.3 | 5.6 | 5.0 |
| TYPE OF IMAGE PATTERN | 1on1off | 11.8 | 0.55 | 0.29 | 0.21 | 0.18 | 0.16 | 0.15 |
| | 1on2off | 7.9 | 0.47 | 2.18 | 1.37 | 0.62 | 0.43 | 0.35 |
| | 1on3off | 5.9 | 0.24 | 0.41 | 0.81 | 2.90 | 2.86 | 1.10 |
| | 1on4off | 4.7 | 0.19 | 0.28 | 0.41 | 0.66 | 1.20 | 3.63 |
| | 1on5off | 3.9 | 0.16 | 0.23 | 0.31 | 0.43 | 0.62 | 0.94 |

IMAGE FORMING APPARATUS, METHOD FOR CONTROLLING IMAGE FORMING APPARATUS, AND PROGRAM FOR CONTROLLING IMAGE FORMING APPARATUS

The entire disclosure of Japanese Patent Application No. 2015-242019 filed on Dec. 11, 2015 including description, claims, drawings, and abstract are incorporated herein by reference in its entirety.

BACKGROUND OF THE INVENTION

Field of the Invention

The present invention relates to an image forming apparatus, a method for controlling the image forming apparatus, and a program for controlling the image forming apparatus. More specifically, the present invention relates to an image forming apparatus for electrifying a photoreceptor with the use of an electrification member, a method for controlling the image forming apparatus, and a program for controlling the image forming apparatus.

Description of the Related Art

An electrophotographic image forming apparatus encompasses an MFP (Multi Function Peripheral) provided with a scanner function, a facsimile function, a copying function, a function of a printer, a data communication function, and a server function, a facsimile machine, a copying machine, and a printer.

An image forming apparatus generally forms an image on a sheet of paper by developing an electrostatic latent image formed on an image carrier to form a toner image, transferring this toner image to the sheet of paper, and then fixing the toner image onto the sheet of paper with the use of a fixing unit. Some image forming apparatuses develop an electrostatic latent image on a surface of a photoreceptor with the use of a developing device to form a toner image, transfer the toner image to an intermediate transfer belt with the use of a primary transfer roller, and secondarily transfer the toner image on the intermediate transfer belt to a sheet of paper with the use of a secondary transfer roller. In this case, the photoreceptor and the intermediate transfer belt serve as an image carrier.

A method for electrifying an electrophotographic image encompasses a corona discharge method and a contact discharge method. In those methods, the contact discharge method is an electrification method in which an electrification roller is brought into contact with a photoreceptor and a voltage is applied to the electrification roller to thereby perform proximity discharge and electrify a surface of the photoreceptor. The contact discharge method can advantageously reduce generation of an oxide (for example, ozone) caused by a high-voltage current flowing in the air.

Further, the contact discharge method encompasses a DC electrification method only using a DC (direct current) voltage as an electrification voltage to be applied to the electrification roller and an AC electrification method using a voltage in which an AC (alternating current) component is superimposed on a DC component as an electrification voltage to be applied to the electrification roller.

In the AC electrification method, discharge of electricity and removal of electricity generated between the electrification roller and the photoreceptor are forcibly repeated by an AC component. For this reason, the AC electrification method can advantageously have a higher electrification ability and higher uniformity of a potential on the surface of the electrified photoreceptor, as compared with the DC electrification method. The AC electrification method can also advantageously improve uniformity of development.

Note that the AC electrification method is required to have not only characteristics regarding an image but also performances such as an electrification characteristic and low noise. Generally, the electrification characteristic is a problem at a low frequency, and low noise and securing of durability of the photoreceptor are problems at a high frequency.

Meanwhile, in the AC electrification method, a periodic potential change occurs on the surface of the photoreceptor along a sheet-of-paper conveyance direction (rotation direction) depending upon an electrification frequency which is a frequency of an AC component. In the case where another factor (for example, image pattern) which periodically changes in the sheet-of-paper conveyance direction exists at the time of image formation, the periodic change caused by the AC component and the periodic change caused by the another factor interfere with each other, and this interference is visually recognized on an image as a fringe pattern (interference fringe) in some cases.

As a method for making the interference fringe inconspicuous, there is proposed a method in which a plurality of different values can be set as the electrification frequency and an electrification frequency having an appropriate value is selected in accordance with a printing condition. However, it is difficult to set a plurality of different values as the electrification frequency. Further, values that can be set as the electrification frequency need to be discrete values, and therefore values of the electrification frequency that can be set are limited in some cases.

A technique for reducing interference between a periodic change caused by an AC component and a periodic change caused by another factor is disclosed in, for example, JP 06-242663 A and JP 2008-152233 A. JP 06-242663 A discloses a technique that repeatedly performs an image forming process including a step of electrifying an image carrier by changing an electrification frequency and applying an oscillation voltage to an electrifier. In this technique, the electrification frequency is changed in each of the image forming processes that are repeatedly performed. JP 2008-152233 A discloses a technique that turns on/off superposition of an AC component of an electrification voltage during electrification and uses only a DC component as the electrification voltage.

Each developing roller and each electrification roller are grounded via a photoreceptor at the time of development, and therefore those rollers are electrically connected to each other via the photoreceptor. Thus, in some cases, beat noise is generated due to a shift between a frequency or phase of a developing voltage, which is a voltage applied to the developing roller, and a frequency or phase of an electrification voltage. The beat noise is a phenomenon in which voltage sags and swells are generated in a peak voltage of an AC component of a developing voltage or electrification voltage. In order to suppress generation of beat noise, the phase of the developing voltage is matched with the phase of the electrification voltage by setting a frequency of the AC component of the developing voltage to an integral multiple of the electrification frequency.

From this point of view, the following possibilities are not considered in the techniques of JP 06-242663 A and JP 2008-152233 A; a possibility that the phase of the electrification voltage is shifted by changing the electrification frequency during electrification; and a possibility that the phase of the electrification voltage is shifted by stopping superimposition of the AC component of the electrification voltage during electrification. Thus, in the techniques of JP 06-242663 A and JP 2008-152233 A, it is impossible to suppress generation of beat noise. Further, it is also impossible to suppress generation of an interference fringe caused by interference with a periodic change caused by another factor.

In addition, in the techniques of JP 06-242663 A and JP 2008-152233 A, it is difficult to control the electrification voltage. In the technique of JP 06-242663 A, it is necessary to switch the electrification frequency at a high speed to set the electrification frequency to a desired value while maintaining continuity of the phase of the electrification voltage before/after switching. In the technique of JP 2008-152233 A, it is necessary to control superimposition of the AC component of the electrification voltage with high accuracy so as not to distort the phase (waveform) of the electrification voltage.

SUMMARY OF THE INVENTION

The present invention has been made to solve the above problems, and an object thereof is to provide an image forming apparatus capable of making an interference fringe inconspicuous by a simple method, a method for controlling the image forming apparatus, and a program for controlling the image forming apparatus.

To achieve the abovementioned object, according to an aspect, an image forming apparatus for electrifying a surface of a photoreceptor with the use of an electrification member, reflecting one aspect of the present invention comprises: a first output unit configured to output a first AC voltage; a second output unit configured to output a second AC voltage having the same frequency as a frequency of the first AC voltage and having a phase different from a phase of the first AC voltage; a superimposition unit configured to superimpose, on a DC component, an AC component containing at least one of the first AC voltage and the second AC voltage; and an application unit configured to apply a voltage that has been subjected to superimposition by the superimposition unit to the electrification member, wherein the superimposition unit changes the AC component to be superimposed on the DC component at a predetermined timing.

According to the image forming apparatus, the phase of the second AC voltage is preferably opposite to the phase of the first AC voltage.

According to the image forming apparatus, the superimposition unit preferably switches the AC component to be superimposed between the first AC voltage and the second AC voltage.

According to the image forming apparatus, the superimposition unit preferably changes the AC component to be superimposed on the DC component among a first state in which an AC component containing the first AC voltage is superimposed on the DC component, a second state in which an AC component containing the second AC voltage is superimposed on the DC component, and a third state in which a voltage of 0 V obtained by combining the first and second AC voltages is superimposed on the DC voltage at a timing between the first state and the second state.

According to the image forming apparatus, a frequency of an AC component of a developing voltage to be applied to a developing roller for developing an electrostatic latent image formed on the surface of the photoreceptor is preferably an integral multiple of a frequency of each of the first and second AC voltages.

According to the image forming apparatus, in the case where n is a natural number, the superimposition unit preferably changes the AC component to be superimposed at an interval that is n times longer than a single period of the first and second AC voltages.

According to the image forming apparatus, the superimposition unit preferably has a plurality of different integral values as a value of n indicating the interval of change of the AC component to be superimposed.

According to the image forming apparatus, a half period of each of the first and second AC voltages is preferably equal to an integral multiple of a single period of an AC component of a developing voltage to be applied to a developing roller for developing an electrostatic latent image formed on the surface of the photoreceptor, and in the case where m is a natural number, the superimposition unit preferably changes the AC component to be superimposed at an interval that is m times longer than the single period of the AC component of the developing voltage.

According to the image forming apparatus, the superimposition unit preferably has a plurality of different integral values as a value of m indicating the interval of change of the AC component to be superimposed.

According to the image forming apparatus, the superimposition unit preferably changes the AC component to be superimposed on the DC component at a timing determined on the basis of at least one of an image pattern, a system speed, and a frequency of an electrification voltage.

To achieve the abovementioned object, according to an aspect, there is provided a non-transitory recording medium storing a computer readable program for controlling an image forming apparatus for electrifying a surface of a photoreceptor with the use of an electrification member, wherein the image forming apparatus includes a first output unit configured to output a first AC voltage and a second output unit configured to output a second AC voltage having the same frequency as a frequency of the first AC voltage and having a phase different from a phase of the first AC voltage, the program reflecting one aspect of the present invention causes a computer to execute: a superimposition step of superimposing, on a DC component, an AC component containing at least one of the first AC voltage and the second AC voltage; and an application step of applying a voltage that has been subjected to superimposition in the superimposition step to the electrification member, and in the superimposition step, the AC component to be superimposed on the DC component is changed at a predetermined timing.

According to the non-transitory recording medium storing a computer readable program for controlling an image forming apparatus, the phase of the second AC voltage is preferably opposite to the phase of the first AC voltage.

According to the non-transitory recording medium storing a computer readable program for controlling an image forming apparatus, in the superimposition step, the AC component to be superimposed is preferably switched between the first AC voltage and the second AC voltage.

According to the non-transitory recording medium storing a computer readable program for controlling an image forming apparatus, in the superimposition step, the AC component to be superimposed on the DC component is preferably changed among a first state in which an AC component containing the first AC voltage is superimposed on the DC component, a second state in which an AC component containing the second AC voltage is superimposed on the DC component, and a third state in which a voltage of 0 V obtained by combining the first and second AC voltages is superimposed on the DC voltage at a timing between the first state and the second state.

According to the non-transitory recording medium storing a computer readable program for controlling an image forming apparatus, a frequency of an AC component of a developing voltage to be applied to a developing roller for developing an electrostatic latent image formed on the surface of the photoreceptor is preferably an integral multiple of a frequency of each of the first and second AC voltages.

According to the non-transitory recording medium storing a computer readable program for controlling an image forming apparatus, in the superimposition step, in the case where n is a natural number, the AC component to be superimposed is preferably changed at an interval that is n times longer than a single period of the first and second AC voltages.

According to the non-transitory recording medium storing a computer readable program for controlling an image forming apparatus, in the superimposition step, a plurality of different integral values is preferably set as a value of n indicating the interval of change of the AC component to be superimposed.

According to the non-transitory recording medium storing a computer readable program for controlling an image forming apparatus, a half period of each of the first and second AC voltages is preferably equal to an integral multiple of a single period of an AC component of a developing voltage to be applied to a developing roller for developing an electrostatic latent image formed on the surface of the photoreceptor, and in the superimposition step, in the case where m is a natural number, the AC component to be superimposed is preferably changed at an interval that is m times longer than the single period of the AC component of the developing voltage.

According to the non-transitory recording medium storing a computer readable program for controlling an image forming apparatus, in the superimposition step, a plurality of different integral values is preferably set as a value of m indicating the interval of change of the AC component to be superimposed.

According to the non-transitory recording medium storing a computer readable program for controlling an image forming apparatus, in the superimposition step, the AC component to be superimposed on the DC component is preferably changed at a timing determined on the basis of at least one of an image pattern, a system speed, and a frequency of an electrification voltage.

To achieve the abovementioned object, according to an aspect, there is provided a method for controlling an image forming apparatus for electrifying a photoreceptor with the use of an electrification member, the image forming apparatus including a first output unit configured to output a first AC voltage and a second output unit configured to output a second AC voltage having the same frequency as a frequency of the first AC voltage and having a phase different from a phase of the first AC voltage, and the method reflecting one aspect of the present invention comprises: a superimposition step of superimposing, on a DC component, an AC component containing at least one of the first AC voltage and the second AC voltage; and an application step of applying a voltage that has been subjected to superimposition in the superimposition step to the electrification member, wherein in the superimposition step, the AC component to be superimposed on the DC component is changed at a predetermined timing.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 3A to 3D are graphs showing a time change in an AC component of an electrification voltage generated by the image forming apparatus in the first embodiment of the present invention;

FIG. 4 is a table for explaining a modification example of an interval of switching of an AC component to be superimposed on a DC component in the first embodiment of the present invention;

FIG. 8 is a table for explaining an example of an interval of switching of an AC component to be superimposed on a DC component in a third embodiment of the present invention;

FIG. 9 is a table showing a relationship between a combination of an image pattern and a frequency of an electrification voltage and a period of a generated interference fringe (pitch of interference);

DESCRIPTION OF THE PREFERRED EMBODIMENTS

Hereinafter, an embodiment of the present invention will be described with reference to the drawings. However, the scope of the invention is not limited to the illustrated examples.

In the following embodiments, a case where an image forming apparatus is an MFP will be described. The image forming apparatus may be not only the MFP but also a facsimile machine, a copying machine, a printer, or the like.

First Embodiment

A configuration of an image forming apparatus in this embodiment will be described.

Figure 1:
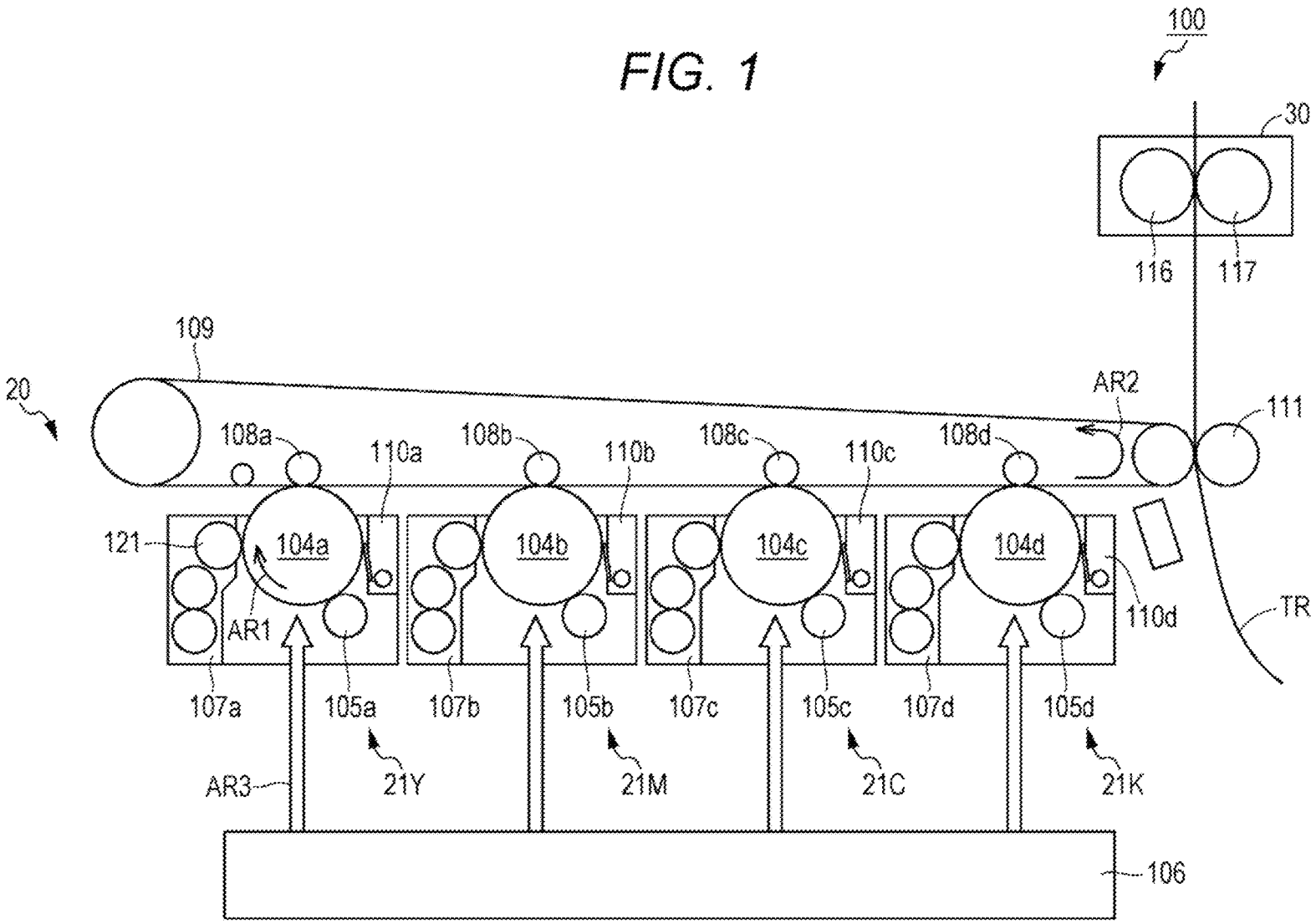
FIG. 1 is a cross-sectional view of a configuration in the vicinity of an intermediate transfer belt of an image forming apparatus in a first embodiment of the present invention.

FIG. 1 is a cross-sectional view of a configuration in the vicinity of an intermediate transfer belt 109 of an image forming apparatus 100 in a first embodiment of the present invention.

When referring to FIG. 1, the image forming apparatus 100 in this embodiment is a tandem MFP in which image forming units 21Y, 21M, 21C, and 21K are arranged in a horizontal direction and includes a toner image forming unit 20, a fixing device 30, and the like. The toner image forming unit 20 combines images of four colors of Y (yellow), M (magenta), C (cyan), and K (block) by a so-called tandem method and transfers toner images to a sheet of paper. The toner image forming unit 20 includes four image forming units 21Y, 21M, 21C, and 21K, an exposure device (print head) 106, the intermediate transfer belt 109, primary transfer rollers 108*a*, 108*b*, 108*c*, and 108*d*, a secondary transfer roller 111, and the like.

The image forming units 21Y, 21M, 21C, and 21K are arranged side by side immediately below the intermediate transfer belt 109 so as to face to the intermediate transfer belt 109. The image forming unit 21Y includes a photoreceptor 104*a*, an electrification roller 105*a*, a developing device 107*a*, a cleaning device 110*a*, and the like. The photoreceptor 104*a* is rotatably driven in a direction indicated by an arrow AR1 in FIG. 1. The electrification roller 105*a*, the developing device 107*a*, and the cleaning device 110*a* are placed around the photoreceptor 104*a*.

The image forming unit 21M includes a photoreceptor 104*b*, an electrification roller 105*b*, a developing device 107*b*, a cleaning device 110*b*, and the like. The image forming unit 21C includes a photoreceptor 104*c*, an electrification roller 105*c*, a developing device 107*c*, a cleaning device 110*c*, and the like. The image forming unit 21K includes a photoreceptor 104*d*, an electrification roller 105*d*, a developing device 107*d*, a cleaning device 110*d*, and the like. Each of the image forming units 21M, 21C, and 21K has a configuration similar to that of the image forming unit 21Y.

The exposure device 106 is provided below the image forming units 21Y, 21M, 21C, and 21K. The intermediate transfer belt 109 is provided above the image forming units 21Y, 21M, 21C, and 21K. The intermediate transfer belt 109 has a ring shape and is rotatably driven in a direction indicated by an arrow AR2 in FIG. 1 in conjunction with a conveyance unit (not shown) for conveying a recording medium. The primary transfer rollers 108*a*, 108*b*, 108*c*, and 108*d* face to the photoreceptors 104*a*, 104*b*, 104*c*, and 104*d*, respectively, via the intermediate transfer belt 109. The secondary transfer roller 111 is in contact with the intermediate transfer belt 109 on a transfer route TR. A space between the secondary transfer roller 111 and the intermediate transfer belt 109 is adjustable by a pressure-contact/separation mechanism (not shown).

The fixing device 30 includes a heating roller 116 and a pressure roller 117. The fixing device 30 conveys the sheet of paper carrying the toner images along the transfer route TR while holding the sheet of paper with a nip portion between the heating roller 116 and the pressure roller 117, thereby fixing the toner images onto the sheet of paper.

When the image forming apparatus 100 accepts an execution instruction of a printing job, recording media such as sheets of paper stored in a paper feed tray (not shown) are drawn out one by one and each recording medium is conveyed along the transfer route TR. Surfaces of the photoreceptors 104*a*, 104*b*, 104*c*, and 104*d* of the respective YMCK colors are electrified by the respective electrification rollers 105*a*, 105*b*, 105*c*, and 105*d* of the respective YMCK colors and then exposure based on image data is performed by laser beams (arrows AR3 in FIG. 1) generated from the exposure device 106 while the recording medium is being conveyed. In this way, electrostatic latent images are formed on the surfaces of the respective photoreceptors 104*a*, 104*b*, 104*c*, and 104*d*. Meanwhile, in each of the developing devices 107*a*, 107*b*, 107*c*, and 107*d*, toner is supplied to a developing roller 121 by a toner supply member. The toner is in the form of a thin film on the developing roller 121. A developing voltage containing an AC component is applied to the developing roller 121. The electrostatic latent images are developed with toner by the developing rollers 121 of the respective developing devices 107*a*, 107*b*, 107*c*, and 107*d* of the respective YMCK colors. In this way, toner images are formed on the surfaces of the respective photoreceptors 104*a*, 104*b*, 104*c*, and 104*d*. Those toner images are transferred onto the intermediate transfer belt 109 by using transfer bias applied to the primary transfer rollers 108*a*, 108*b*, 108*c*, and 108*d* of the respective YMCK colors. In this way, the toner images of the respective YMCK colors are superimposed and formed on the intermediate transfer belt 109.

The toner images on the intermediate transfer belt 109 are collectively transferred by secondary transfer bias applied to the secondary transfer roller 111 onto the recording medium conveyed between the intermediate transfer belt 109 and the secondary transfer roller 111.

The toner images formed on the recording medium are fixed onto the recording medium by applying heat and pressure thereto when the recording medium passes through the fixing device 30. The recording medium onto which the toner images have been fixed is discharged to the outside of the image forming apparatus 100.

Note that an intermediate transfer member may be not only a belt-like member such as the above intermediate transfer belt 109 but also a drum-like member.

Configurations and arrangement of members in the above image forming apparatus 100 are merely examples. The image forming apparatus may have a configuration that develops only monochrome color (single color) or another configuration and may have another arrangement.

Hereinafter, a photoreceptor, an electrification roller, and a developing device of an arbitrary image forming unit among the image forming units 21Y, 21M, 21C, and 21K are referred to as "photoreceptor 104", "electrification roller 105" (example of electrification member), and "developing device 107", respectively, in some cases.

Figure 2:
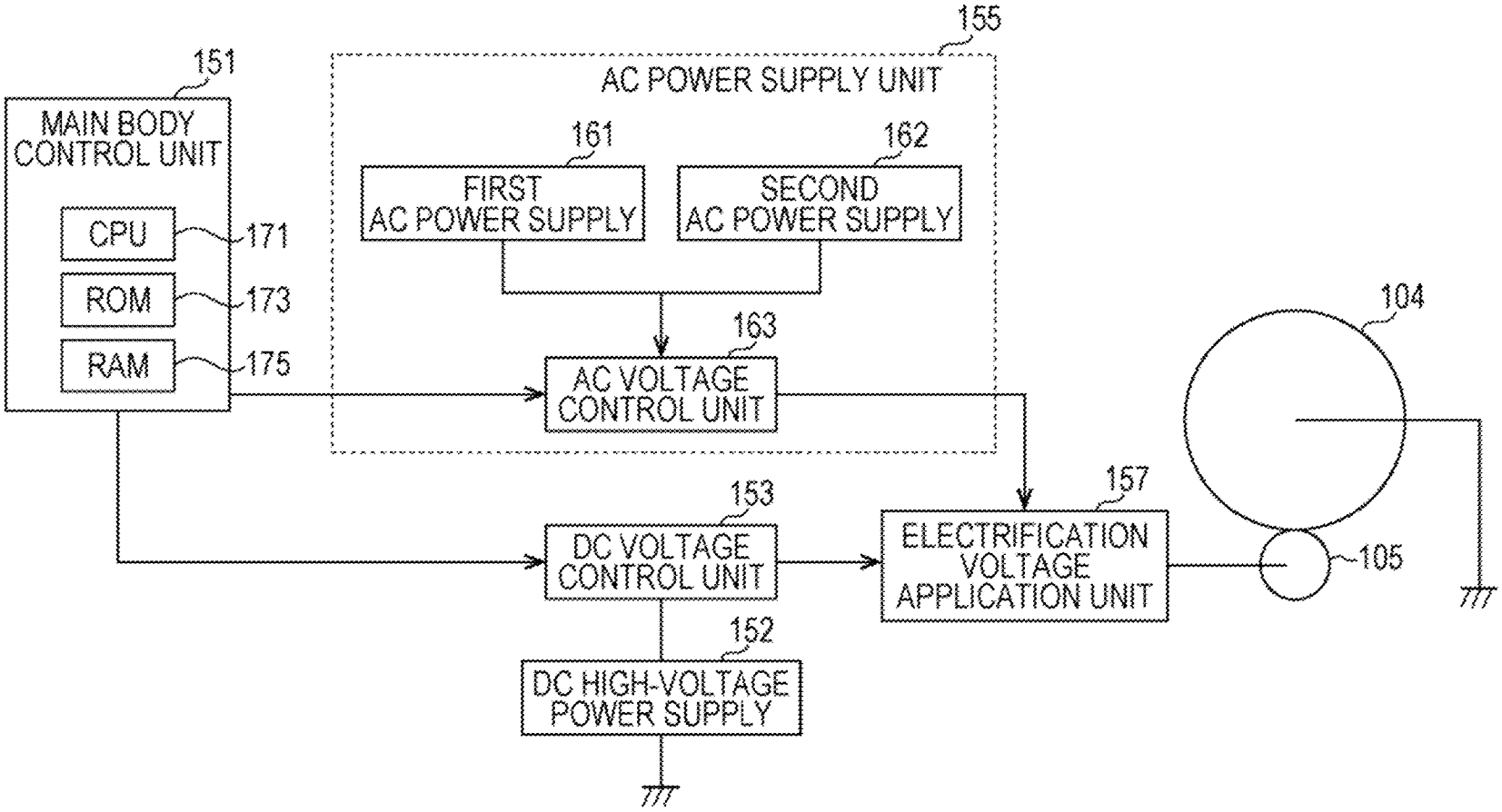
FIG. 2 is a block diagram of a control configuration of the image forming apparatus in the first embodiment of the present invention.

FIG. 2 is a block diagram of a control configuration of the image forming apparatus 100 in the first embodiment of the present invention.

When referring to FIG. 2, the image forming apparatus 100 includes a main body control unit 151, a DC high-voltage power supply 152, a DC voltage control unit 153, an AC power supply unit 155, and an electrification voltage application unit 157 (example of application unit). The main body control unit 151, the DC voltage control unit 153, and the AC power supply unit 155 are connected to one another. The DC high-voltage power supply 152 is connected to the DC voltage control unit 153.

The main body control unit 151 controls the whole image forming apparatus 100. The main body control unit 151 outputs an AC output control signal for controlling an AC component to be superimposed on a DC component to an AC voltage control unit 163. The main body control unit 151 includes a CPU (Central Processing Unit) 171, a ROM (Read Only Memory) 173, and a RAM (Random Access Memory) 175. The CPU 171 performs processing on the basis of a control program. The ROM 173 stores, for example, the control program executed by the CPU 171. The RAM 175 is a working memory for the CPU 171 and temporarily stores data regarding various jobs.

The DC high-voltage power supply 152 generates a DC voltage. The DC voltage control unit 153 controls output of the DC high-voltage power supply 152 in response to an instruction from the main body control unit 151 and outputs a DC component generated in the DC high-voltage power supply 152 to the electrification voltage application unit 157.

In response to an instruction from the main body control unit 151, the AC power supply unit 155 superimposes an AC component on the DC component output by the DC voltage control unit 153. The AC power supply unit 155 includes a first AC power supply 161 (example of first output unit), a second AC power supply 162 (example of second output unit), and the AC voltage control unit 163 (example of superimposition unit). The first AC power supply 161 generates (outputs) a first AC voltage. The second AC power supply 162 generates (outputs) a second AC voltage. The second AC voltage is an AC voltage having the same frequency as a frequency of the first AC voltage and having a phase opposite to a phase of the first AC voltage.

Note that the second AC voltage may be generated by providing a converter for reversing a waveform of the first AC voltage between the first AC power supply 161 and the AC voltage control unit 163, instead of the second AC power supply 162.

Based on an AC output control signal from the main body control unit 151, the AC voltage control unit 163 superimposes an AC component containing at least one of the first AC voltage and the second AC voltage on the DC component output by the DC voltage control unit 153. The AC voltage control unit 163 changes the AC component to be superimposed on the DC component at a predetermined timing.

In an electrification step, the electrification voltage application unit 157 applies an electrification voltage, which is a voltage after the AC component is superimposed on the DC component, to the electrification roller 105. The image forming apparatus 100 electrifies the surface of the photoreceptor 104 with the use of the electrification roller 105 to which the electrification voltage is applied.

In this embodiment, the image forming apparatus 100 switches the first AC voltage and the second AC voltage which have a relationship in which phases are reversed with each other at a predetermined interval during electrification. The AC component generated by the image forming apparatus 100 will be described.

The interval means a time period for continuously outputting the first AC voltage or the second AC voltage to the electrification voltage application unit 157.

FIGS. 3A to 3D are graphs showing a time change in an AC component of an electrification voltage generated by the image forming apparatus 100 in the first embodiment of the present invention. FIG. 3A is a graph showing a time change in a first AC voltage. FIG. 3B is a graph showing a time change in a second AC voltage. FIG. 3C is a graph showing a time change in an AC output control signal. FIG. 3D is a graph showing a time change in an AC component output by the AC power supply unit 155.

When referring to FIG. 2 and FIGS. 3A to 3D, the first AC voltage generated by the first AC power supply 161 has, for example, a frequency of 0.5 kHz to 3.0 kHz and an amplitude of 1.0 kVpp to 2.0 kVpp. The first AC voltage has a waveform of, for example, a sine wave. The second AC voltage generated by the second AC power supply 162 has a waveform in which positive/negative of a waveform of the first AC voltage is reversed, i.e., a waveform in which a phase of the first AC voltage is shifted by n.

The AC output control signal has, for example, a rectangular shape. The AC output control signal has two output levels, i.e., H (high) and L (low). Based on the AC output control signal, the AC voltage control unit 163 switches an AC component to be superimposed on a DC component between the first AC voltage and the second AC voltage. That is, in the case where the AC output control signal is H, the AC voltage control unit 163 outputs only the first AC voltage to the electrification voltage application unit 157 (turns on the first AC voltage) and does not output the second AC voltage to the electrification voltage application unit 157 (turns off the second AC voltage). In this case, the AC component containing only the first AC voltage is superimposed on the DC component. In the case where the AC output control signal is L, the AC voltage control unit 163 outputs only the second AC voltage to the electrification voltage application unit 157 (turns on the second AC voltage) and does not output the first AC voltage to the electrification voltage application unit 157 (turns off the first AC voltage). In this case, the AC component containing only the second AC voltage is superimposed on the DC component.

The AC voltage control unit 163 preferably switches the AC component to be superimposed on the DC component at an interval that is n times (n is an arbitrary natural number) longer than a single period of the first and second AC voltages. In FIG. 3C, the AC voltage control unit 163 switches one AC voltage to the other one of the first and second AC voltages at an interval of a time period for three periods of the first and second AC voltages. In this way, the AC component shown in FIG. 3D has a waveform in which sine waves whose phase is reversed every three periods are alternately repeated. Further, the first AC voltage and the second AC voltage are switched at a time at which the AC component becomes zero. The natural number n is preferably 1 or more but 10 or less.

FIG. 4 is a table for explaining a modification example of an interval of switching of an AC component to be superimposed on a DC component in the first embodiment of the present invention.

When referring to FIG. 4, the AC voltage control unit 163 may have a plurality of different integral values as a value of n indicating the interval of switching of the AC component to be superimposed.

A top section in the table shows an elapsed time from the start of electrification by using the number of generated waves in a single period of the first and second AC voltages. A middle section in the table shows the kind of AC component (first or second AC voltage) to be superimposed on the DC component. A bottom section shows an interval serving as a switching timing by using the number of waves in a single period of the first and second AC voltages.

Specifically, when electrification is started, the first AC voltage is superimposed on a DC component as an AC component. The AC component to be superimposed on the DC component is switched to the second AC voltage at an interval for six periods of the first and second AC voltages from the start of electrification. The AC component to be superimposed on the DC component is switched to the first AC voltage at an interval for seven periods of the first and second AC voltages after the AC component is switched. Thereafter, the AC components to be superimposed on the DC component are alternately switched at intervals for six periods, four periods, five periods, and eight periods of the first and second AC voltages.

Figure 5:
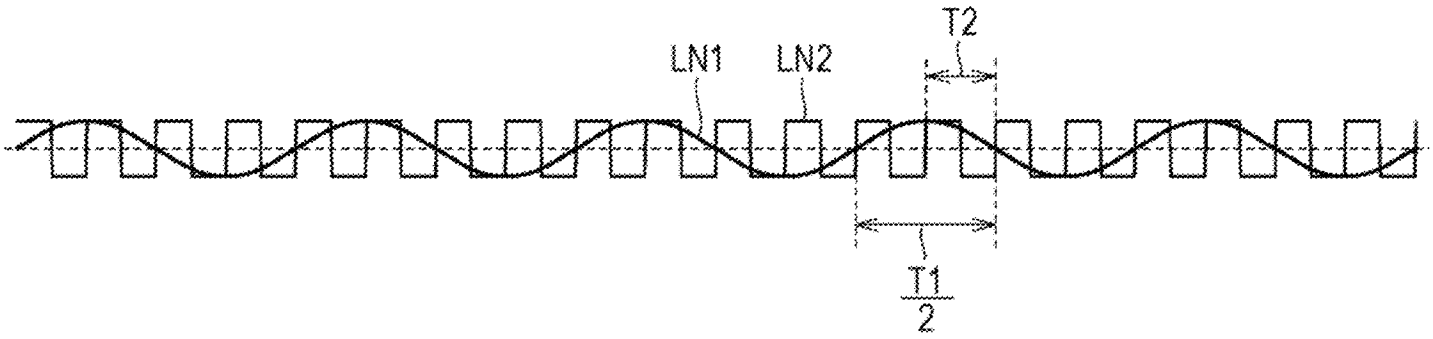
FIG. 5 is a graph showing a relationship between a time change in a first or second AC voltage generated by the image forming apparatus and a time change in an AC component of a developing voltage in the first embodiment of the present invention.

FIG. 5 is a graph showing a relationship between a time change in a first or second AC voltage generated by the image forming apparatus 100 and a time change in an AC component of a developing voltage in the first embodiment of the present invention. Note that, in FIG. 5, a line indicating the time change in the first or second AC voltage is a line LN1, and a line indicating the time change in the AC component of the developing voltage is a line LN2.

When referring to FIG. 5, herein, each of the first and second AC voltages has, for example, a frequency of 2 kHz to 12 kHz and an amplitude of 1.5 to 4.0 kVpp. Meanwhile, the AC component of the developing voltage has a rectangular shape and is configured so that both a duty ratio on the positive side and a duty ratio on the negative side have 50%. Note that the AC component of the developing voltage may have a rectangular wave having a duty ratio other than 50% or may have a sine wave, a triangular wave, or the like.

Generally, a frequency of the developing voltage is set to be higher than a frequency of the electrification voltage. The frequency of the AC component of the developing voltage is preferably an integral multiple (herein, four times) of the frequency of each of the first and second AC voltages.

When the frequency of the AC component of the developing voltage is set to an integral multiple of the frequency of each of the first and second AC voltages, a time period for a half-wave length of the AC component of the electrification voltage and a time period for two periods of the AC component of the developing voltage always match with each other even in the case where switching of the AC component of the electrification voltage is controlled during electrification as in this embodiment. In this way, it is possible to suppress a shift between a phase of the developing voltage and a phase of the electrification voltage, and it is possible to avoid generation of beat noise or generation of voltage sags and swells.

A phase of potential distribution on a surface of the electrified photoreceptor is also changed by switching the electrification voltage. Therefore, in order to maintain all the phases of the periodic distribution on an image, ultimately, it is ideal to change the phase of the developing voltage in accordance with the phase of the potential distribution on the surface of the photoreceptor. However, in the case where the phase of the electrification voltage is changed during electrification without considering the phase or electrification voltages having a plurality of different electrification frequencies are used as the electrification voltage, it is extremely difficult to match the phase of the developing voltage with the phase of the electrification voltage in accordance therewith. In this embodiment, the electrification frequency is constant and the phase of the electrification voltage is also controlled, and therefore there is no problem even in the case where the developing voltage is not precisely controlled. It is because, in this embodiment, a relationship between the electrification voltage and the developing voltage, which is obtained in the case where the AC component containing the first AC voltage is superimposed, is always the same, and a relationship between the electrification voltage and the developing voltage, which is obtained in the case where the AC component containing the second AC voltage is superimposed, is always the same.

An effect of this embodiment will be described.

In this embodiment, the first AC voltage and the second AC voltage having the same frequency and having opposite phases are alternately superimposed on a DC component as an AC component during electrification. This makes it possible to make an interference fringe between an AC component of an electrification voltage and an image pattern (screen pattern) inconspicuous, and it is possible to reduce interference between the AC component of the electrification voltage and an AC component of a developing voltage.

That is, there is assumed a state in which an interference fringe is generated at a visually recognized period as a result of use of an electrification voltage in which an AC component having a constant phase (for example, an AC component containing only the first AC voltage) is superimposed. In this state, when a section in which an AC component (for example, an AC component containing only the second AC voltage) whose phase is reversed is inserted into the period of the interference fringe, strength/weakness of interference is reversed in the section of the reversed AC component. Therefore, when the first AC voltage and the second AC voltage which have a relationship in which phases are reversed are alternately superimposed in the period of the interference as the AC component, it is possible to change a degree of waviness of the interference and make the interference fringe inconspicuous.

In addition, when there is a mechanism for generating the first AC voltage serving as a reference, it is possible to easily and securely obtain output of the second AC voltage only by reversing output of the first AC voltage. As a result, it is possible to make an interference fringe inconspicuous by a simple method without increasing the kind of frequency of an electrification voltage. Further, it is possible to maintain desired performances of an electrification device, such as an electrification function and a low-noise function.

Further, an AC component to be superimposed on a DC component is prepared by switching the first AC voltage and the second AC voltage, and therefore phases or frequencies of the first and second AC voltages themselves are not changed. As a result, it is possible to maintain a relationship between another factor such as a developing voltage set in advance and an AC component of an electrification voltage without changing the relationship.

Note that, although the first AC voltage and the second AC voltage are switched at a timing at which an AC component becomes zero in this embodiment, the timing to switch the first AC voltage and the second AC voltage is arbitrary. However, when switching is performed at an interval equal to or less than a single period of the first and second AC voltages, it is difficult to obtain an original electrification function. Therefore, the interval of switching between the first AC voltage and the second AC voltage is preferably a time period longer than a single period of the first and second AC voltages. Further, in the case where an interference fringe generated by interference between an AC component of an electrification voltage and an image pattern is visually recognized, the interference fringe remains even in the case where the first AC voltage and the second AC voltage are switched at an interval longer than a period of the interference fringe. Therefore, the interval of switching between the first AC voltage and the second AC voltage is preferably a time period shorter than the period of the interference fringe, and the interval is preferably a time period that is about half of the period of the interference fringe, for example.

Second Embodiment

Figure 6:
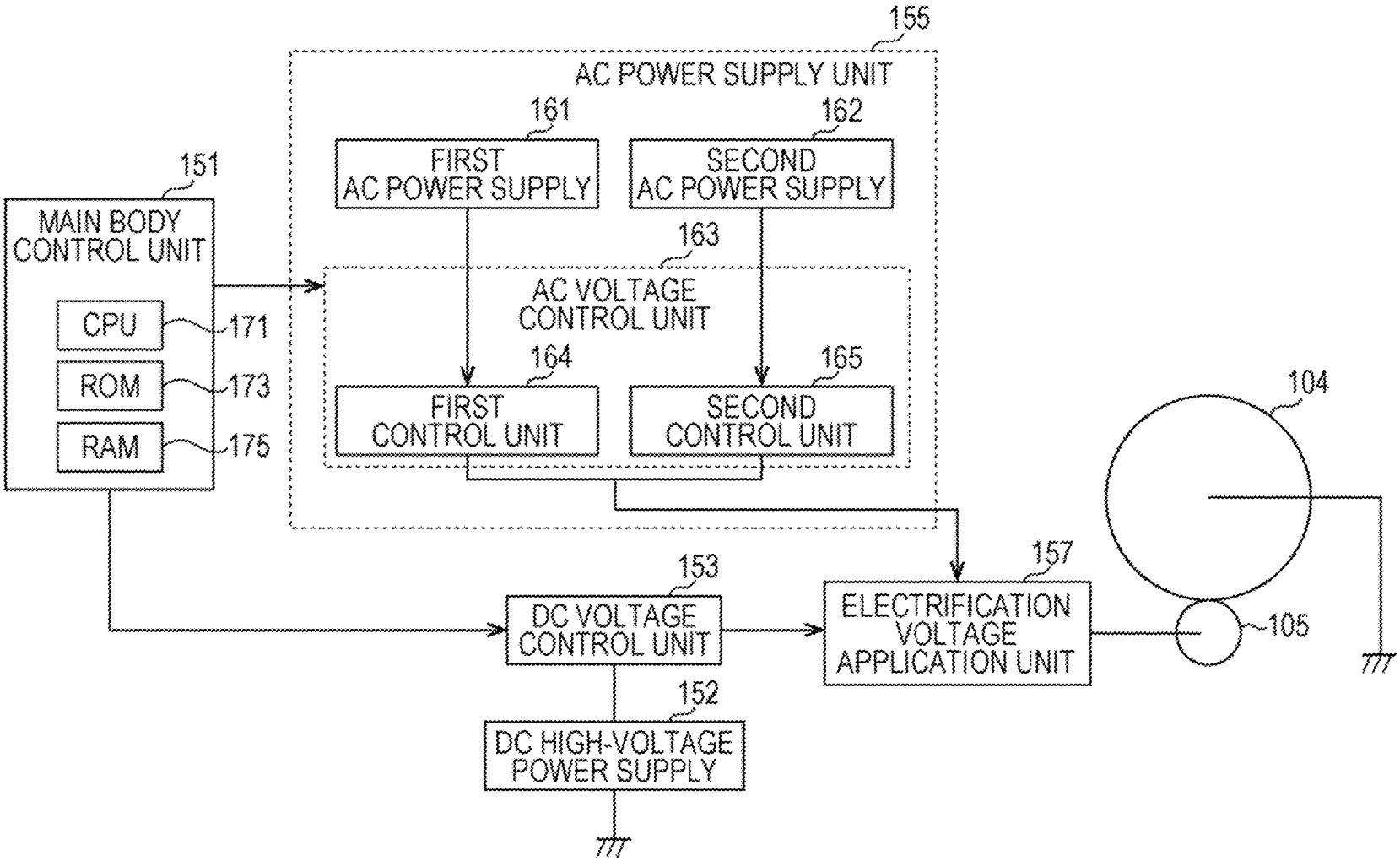
FIG. 6 is a block diagram showing a control configuration of an image forming apparatus in a second embodiment of the present invention.

FIG. 6 is a block diagram showing a control configuration of the image forming apparatus 100 in the second embodiment of the present invention.

When referring to FIG. 6, in this embodiment, an AC component to be superimposed on a DC component is controlled by using two independent AC output control signals. The main body control unit 151 outputs both first and second AC output control signals for controlling an AC component to be superimposed on a DC component to the AC voltage control unit 163. The AC voltage control unit 163 includes a first control unit 164 and a second control unit 165. The first control unit 164 controls whether to output a first AC voltage to the electrification voltage application unit 157 on the basis of a first AC output control signal from the main body control unit 151. The second control unit 165 controls whether to output a second AC voltage to the electrification voltage application unit 157 on the basis of a second AC output control signal from the main body control unit 151.

In this embodiment, the image forming apparatus 100 superimposes an AC component containing at least one of the first AC voltage and the second AC voltage which have a relationship in which phases are reversed with each other on a DC component. The AC component generated by the image forming apparatus 100 will be described.

Figures 7A, 7B, 7C, 7D:
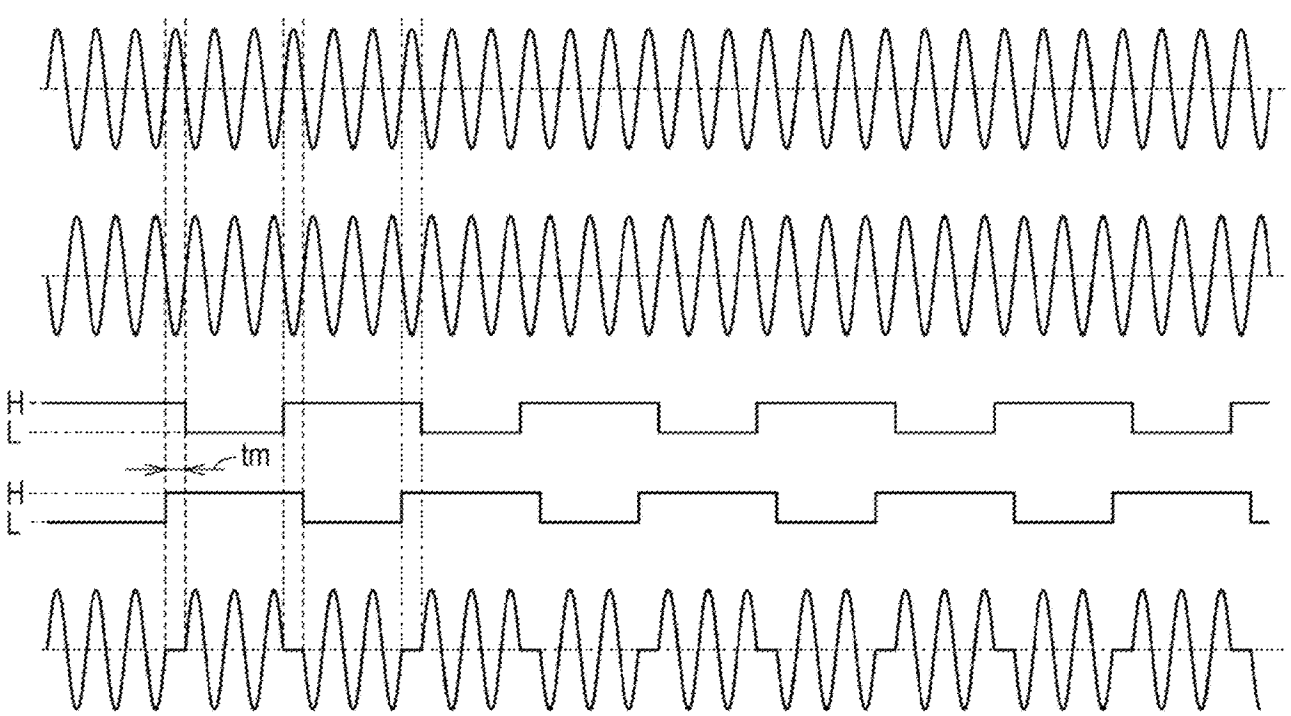
FIGS. 7A to 7D are graphs showing a time change in an AC component generated by the image forming apparatus in the second embodiment of the present invention.

FIGS. 7A to 7D are graphs showing a time change in an AC component generated by the image forming apparatus 100 in the second embodiment of the present invention. FIG. 7A is a graph showing a time change in a first AC voltage. FIG. 7B is a graph showing a time change in a second AC voltage. FIG. 7C is a graph showing a time change in an AC output control signal. FIG. 7D is a graph showing a time change in an AC component output by the AC power supply unit 155.

When referring to FIG. 6 and FIGS. 7A to 7D, each of the first and second AC output control signals is, for example, a rectangular digital signal. Each of the first and second AC output control signals has two output levels, i.e., H (high) and L (low). In the case where the first AC output control signal is H, the first control unit 164 outputs (turns on) the first AC voltage to the electrification voltage application unit 157, and, in the case where the first AC output control signal is L, the first control unit 164 does not output (turns off) the first AC voltage to the electrification voltage application unit 157. In the case where the second AC output control signal is H, the second control unit 165 outputs (turns on) the second AC voltage to the electrification voltage application unit 157, and, in the case where the second AC output control signal is L, the second control unit 165 does not output (turns off) the second AC voltage to the electrification voltage application unit 157.

When comparing the first and second AC output signals in this embodiment with the AC output signal in the first embodiment, a timing at which the AC output signal in the first embodiment is switched from L to H is the same as a timing at which each of the first and second AC output control signals in this embodiment is switched from L to H. Meanwhile, a timing at which each of the first and second AC output control signals in this embodiment is switched from H to L is a half period later than a timing at which the AC output signal in the first embodiment is switched from H to L.

Because the timing at which each of the first and second AC output control signals is switched from H to L is delayed for a half period, both the first AC voltage and the second AC voltage are output as the AC component in a time period tm corresponding to the delayed half period. An AC voltage serving as the AC component is switched before/after the time period tm. Because the first AC voltage and the second AC voltage have opposite phases, the first AC voltage and the second AC voltage cancel each other in the time period tm, and the voltage of the AC component is substantially zero. In other words, the AC voltage control unit 163 changes the AC component among a first state in which an AC component containing the first AC voltage is superimposed on a DC component, a second state in which an AC component containing the second AC voltage is superimposed on a DC component, and a third state in which a voltage of 0 V obtained by combining the first and second AC voltages is superimposed on a DC voltage at a timing between the first state and the second state.

Note that configurations and operation of the image forming apparatus 100 other than those described above are similar to the case of the first embodiment. Therefore, the same members are denoted by the same reference symbols, and description thereof will not be repeated.

According to this embodiment, a voltage of an AC component is substantially zero at a timing at which the AC component is switched between the first AC voltage and the second AC voltage. This makes it possible to prevent a waveform of the AC component from being shifted to a positive side or negative side in the case where the waveform of the AC component or a switching timing is shifted.

Third Embodiment

In the above embodiment, an AC component to be superimposed on a DC component is changed at a timing based on a period of an electrification voltage. Instead, in this embodiment, there will be described a case where an AC component to be superimposed on a DC component is changed at a timing based on a period of an AC component of a developing voltage.

As shown in FIG. 5, this embodiment is based on the premise that a half period (T½) of each of the first and second AC voltages is equal to an integral multiple (twice in FIG. 5) of a single period T2 of an AC component of a developing voltage. The AC component of the developing voltage has a constant frequency and is continuously output.

FIG. 8 is a table for explaining an example of an interval of switching of an AC component to be superimposed on a DC component in the third embodiment of the present invention.

When referring to FIG. 8, the AC voltage control unit 163 changes an AC component to be superimposed at an interval that is m times (m is a natural number) longer than a single period of an AC component of a developing voltage. The AC voltage control unit 163 may have a plurality of different integral values as a value of m indicating the interval of switching of the AC component to be superimposed.

A top section in the table shows an elapsed time from the start of electrification by using the number of generated waves in a single period of the AC component of the developing voltage. A middle section in the table shows the kind of AC voltage used as the AC component to be superimposed on the DC component. A bottom section shows an interval serving as a switching timing by using the number of waves in a single period of the electrification voltage.

Specifically, when electrification is started, the first AC voltage is superimposed on a DC component as an AC component. The AC component to be superimposed on the DC component is switched to the second AC voltage at an interval for six periods of the AC component of the developing voltage from the start of electrification. The AC component to be superimposed on the DC component is switched to the first AC voltage at an interval for seven periods of the AC component of the developing voltage after the AC component is switched. Thereafter, the AC components to be superimposed on the DC component are alternately switched at intervals for six periods, four periods, five periods, and eight periods of the AC component of the developing voltage.

Note that m may always be a single value. In this case, a switching timing of the AC component of the electrification voltage seen in terms of a waveform of the developing voltage can always be constant. The natural number m is preferably 1 or more but 10 or less.

According to this embodiment, it is possible to set a switching timing of an AC component at a high degree of freedom by using a timing to start superimposition of an AC component of an electrification voltage or a timing to start image formation as a base point. It is also possible to maintain a relationship between a phase of an electrification voltage and a phase of a developing voltage.

Fourth Embodiment

In this embodiment, a method for selecting an operation mode of the image forming apparatus 100 from an interference-fringe suppression mode and a normal mode will be described. The interference-fringe suppression mode is a mode in which image formation is performed by using an electrification voltage in which an AC component controlled by any one of the methods in the above first to third embodiments is superimposed on a DC component. The normal mode is a mode in which image formation is performed by using an electrification voltage in which an AC component having a frequency and a phase which are always constant is superimposed on a DC component.

FIG. 9 is a table showing a relationship between a combination of an image pattern and a frequency of an electrification voltage and a period of a generated interference fringe (pitch of interference).

When referring to FIG. 9, this table shows a period of an interference fringe generated in the case where image formation is performed in the normal mode. In this table, a system speed (process speed) Vsys is set to 240 mm/sec, frequencies Fc of the electrification voltage are set to six values falling within a range of 1200 Hz to 2400 Hz, and resolution of image patterns is set to 600 dpi. An electrification spatial frequency Fp is a spatial frequency in a surface potential of the photoreceptor 104 and is expressed by the following expression (1).

$$\text{Electrification spatial frequency Fp [lp/mm]} = \text{Frequency } Fc \text{ [Hz] of electrification voltage/System speed Vsys [mm/sec]} \quad (1)$$

The image patterns are assumed to be 5 types, i.e., 1on1off, 1on2off, 1on3off, 1on4off, and 1on5off. The pattern 1on1off is an image pattern in which black for a single pixel and white for a single pixel are alternately arranged in a rotation direction of the photoreceptor 104 (sheet-of-paper conveyance direction). The pattern 1on2off is an image pattern in which black for a single pixel and white for two pixels are alternately arranged in the rotation direction of the photoreceptor 104. The pattern 1on3off is an image pattern in which black for a single pixel and white for three pixels are alternately arranged in the rotation direction of the photoreceptor 104. The pattern 1on4off is an image pattern in which black for a single pixel and white for four pixels are alternately arranged in the rotation direction of the photoreceptor 104. The pattern 1on5off is an image pattern in which black for a single pixel and white for five pixels are alternately arranged in the rotation direction of the photoreceptor 104.

A frequency F of the generated interference fringe corresponds to a difference between the electrification spatial frequency Fp and a spatial frequency Fi of an image pattern and is calculated by the following expression (2). Further, a period T of the generated interference fringe is calculated by the following expression (3).

$$\text{Frequency } F \text{ of generated interference fringe [Hz]} = [Fp - Fi] \quad (2)$$

$$\text{Period } T \text{ (mm) of generated interference fringe} = 1/F \quad (3)$$

Generally, in the case where the period T of the interference fringe is 0.5 mm or less, the interference fringe has such a low level that can be ignored. Therefore, in the case of a combination of a period of an image pattern having the period T of 0.5 mm or less and the frequency of the electrification voltage in this table, an interference fringe is inconspicuous even when image formation is performed in the normal mode.

Meanwhile, in the case of a combination of a period of an image pattern in which the period T is longer than 0.5 mm and the frequency of the electrification voltage, an interference fringe is conspicuous when image formation is performed in the normal mode. For example, in a combination of the image pattern 1on2 and the electrification frequency Fp of 2000 Hz, the period T of the interference fringe is 2.18 mm, and therefore the interference fringe is particularly conspicuous. Therefore, in the case where a combination of an image pattern and a frequency of an electrification voltage is the above combination, it is necessary to perform image formation in the interference-fringe suppression mode.

Therefore, the AC voltage control unit 163 stores information (for example, the table in FIG. 9) indicating a relationship between an image pattern, a system speed, and a frequency of an electrification voltage and necessity of the interference-fringe suppression mode in the ROM 173 or the like in advance, and shifts the normal mode to the interference-fringe suppression mode (changes an AC component to be superimposed on a DC component) at a timing determined on the basis of this information. The AC voltage control unit 163 may shift the normal mode to the interference-fringe suppression mode at a timing determined on the basis of at least one of the image pattern, the system speed, and the frequency of the electrification voltage.

Figure 10:
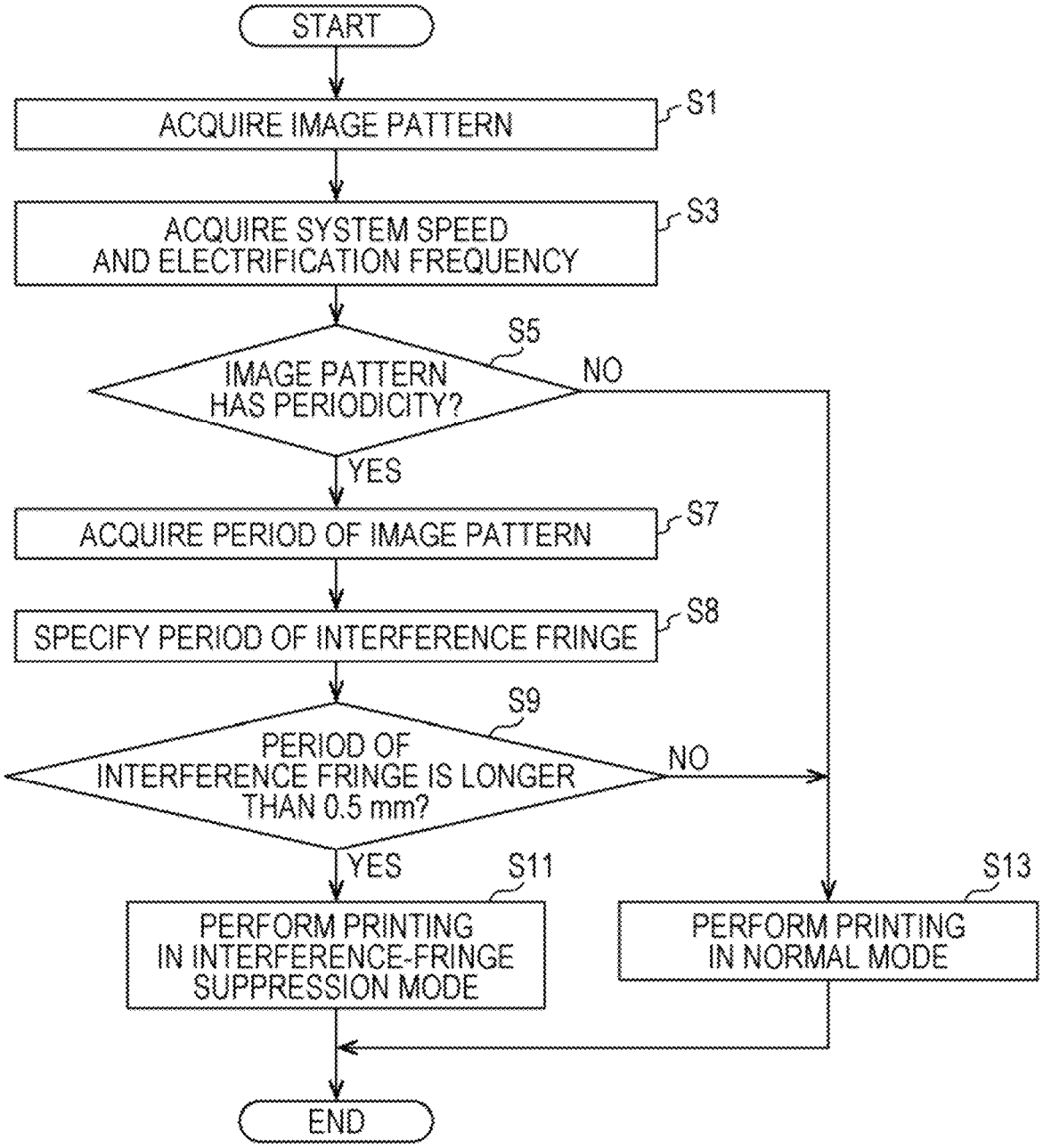
FIG. 10 is a flowchart showing operation of an image forming apparatus in a fourth embodiment of the present invention.

FIG. 10 is a flowchart showing operation of the image forming apparatus 100 in the fourth embodiment of the present invention.

When referring to FIG. 10, the CPU 171 of the image forming apparatus 100 accepts an execution instruction of a print job, the CPU 171 acquires an image pattern of the print job (S1) and acquires a system speed and a frequency of an electrification voltage in the normal mode (S3). Next, the CPU 171 determines whether or not the acquired image pattern has periodicity (S5).

In the case where it is determined that the acquired image pattern has periodicity in Step S5 (YES in S5), the CPU 171 acquires a period of the image pattern (S7). Then, the CPU 171 specifies a period of an interference fringe on the basis of the system speed and the frequency of the electrification voltage (S8) and determines whether or not the period of the interference fringe is longer than 0.5 mm (S9).

In the case where it is determined that the period of the interference fringe is longer than 0.5 mm in Step (S9) (YES in S9), the CPU 171 executes the print job in the interference-fringe suppression mode (S11) and terminates the processing.

In the case where it is determined that the acquired image pattern does not have periodicity in Step S5 (NO in S5) or it is determined that the period of the interference fringe is 0.5 mm or less in Step S9 (NO in S9), the CPU 171 executes the print job in the normal mode (S13) and terminates the processing.

Example

In this example, simulation was performed in order to verify effects of the above embodiments. There was calculated a density distribution generated on an image pattern in the case where the image pattern having periodicity is formed on a recording medium in both the normal mode and the interference-fringe suppression mode.

Figure 11A:
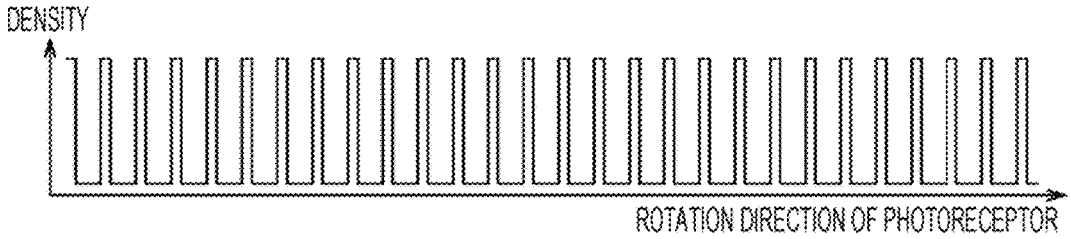
FIGS. 11A to 11E are graphs showing density distribution generated in an image pattern in the case where the image pattern having periodicity is formed on a surface of a photoreceptor in both a normal mode and an interference-fringe suppression mode.
Figure 11B:
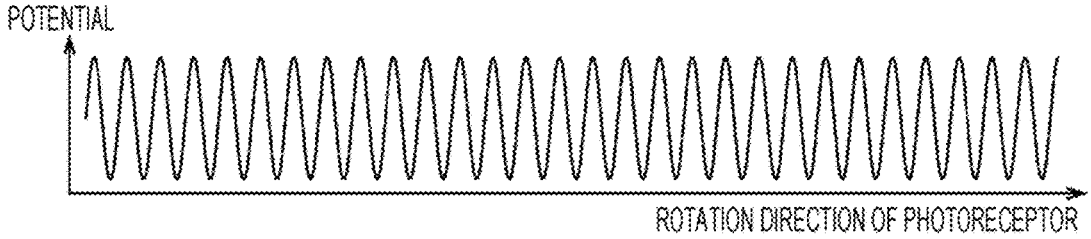
Figure 11C:
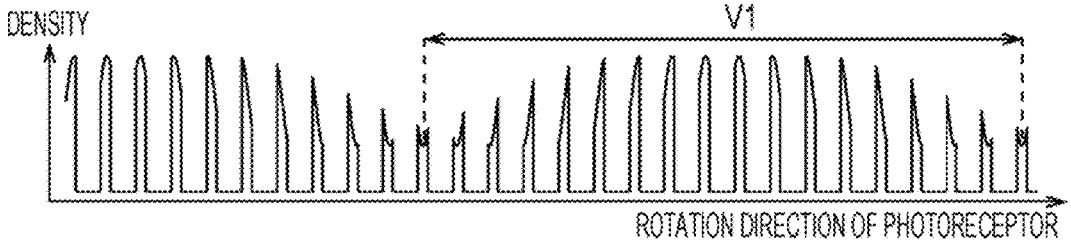
Figure 11D:
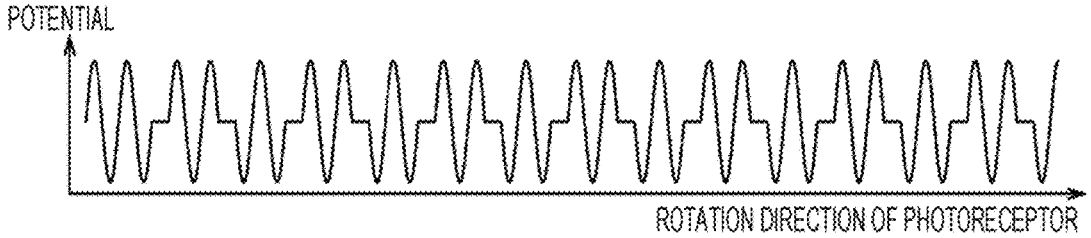
Figure 11E:
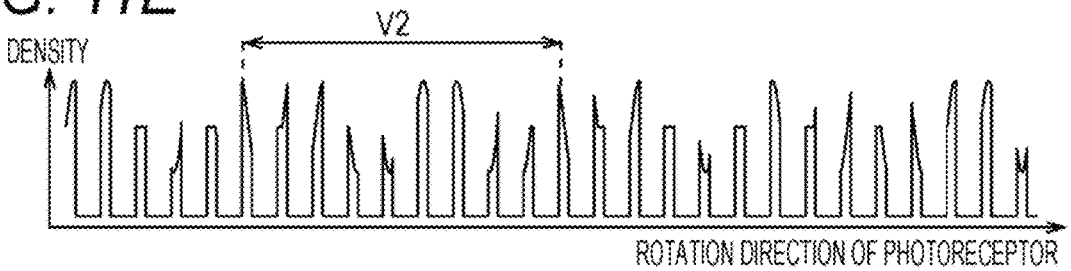

FIGS. 11A to 11E are graphs showing density distribution generated on an image pattern in the case where the image pattern having periodicity is formed on a surface of a photoreceptor in both the normal mode and the interference-fringe suppression mode. FIG. 11A is a graph showing a density distribution in original data of an image pattern 1onkoff (k is a natural number). FIG. 11B is a graph showing a potential distribution formed on the surface of the photoreceptor in the normal mode. FIG. 11C is a graph showing a density distribution of the image pattern formed on the surface of the photoreceptor in the normal mode. FIG. 11D is a graph showing a potential distribution formed on the surface of the photoreceptor in the interference-fringe suppression mode. FIG. 11E is a graph showing a density distribution of the image pattern formed on the surface of the photoreceptor in the interference-fringe suppression mode.

When referring to FIGS. 11A to 11E, a density distribution of an image pattern that is formed on the surface of the photoreceptor in the case where an electrification voltage does not contain an AC component matches with the density distribution of the image pattern shown in FIG. 11A. In the normal mode, an electrification voltage contains an AC component having a frequency and a phase which are always constant as shown in FIG. 11B. Therefore, large waviness shown in FIG. 11C is generated in the density distribution of the image pattern. In FIG. 11C, an interference fringe having a long period referred to as a period V1 is generated.

Meanwhile, in the interference-fringe suppression mode, an electrification voltage contains an AC component formed by using the first and second AC voltages having the same frequency and having different phases as shown in FIG. 11D. Therefore, comparatively small waviness shown in FIG. 11E is generated in the density distribution of the image pattern. In FIG. 11E, an interference fringe having a period V2 shorter than the period V1 is generated. As a result, the interference fringe is made inconspicuous.

[Others]

In the above embodiments, there has been described the case where the electrification device has a configuration that performs electrification by using a roller electrification method. However, the electrification device may have another configuration that performs electrification by using another electrification method that brings the electrification device into contact with a photoreceptor.

The image forming apparatus may have a configuration that directly transfers a toner image formed on a surface of a photoreceptor to a recording medium, instead of a configuration that transfers a toner image formed on a surface of a photoreceptor to a recording medium via an intermediate transfer belt.

A phase of the second AC voltage is not limited to an opposite phase, and the second AC voltage only needs to have a phase different from a phase of the first AC voltage, i.e., the phase of the second AC voltage may be different from the phase of the first AC voltage. In particular, in the case where an AC component to be superimposed on a DC component is configured by a three-phase alternating current, the phase of the second AC voltage and the phase of the first AC voltage are preferably shifted by 120 degrees.

It is possible to combine the above embodiments as appropriate. For example, a configuration in the second embodiment in which a time period in which a voltage of an AC component of an electrification voltage is substantially zero is provided may be combined with a configuration in the third embodiment in which an AC component to be superimposed on a DC component is changed at a timing based on a period of an AC component of a developing voltage.

The processing in the above embodiments may be performed by software or by using a hardware circuit. Further, a program for executing the processing in the above embodiments can be provided, or the program may be recorded on a recording medium such as a CD-ROM, a flexible disk, a hard disk, a ROM, a RAM, or a memory card to be provided to a user. The program is executed by a computer such as a CPU. Further, the program may be downloaded to a device via a communication network such as the Internet.

Although the present invention has been described and illustrated in detail, it is clearly understood that the same is by way of illustrated and example only and is not to be taken by way of limitation, the scope of the present invention being interpreted by terms of the appended claims. The scope of the present invention is intended to include any modifications within the scope and meaning equivalent to the scope of the claims.

What is claimed is:

1. An image forming apparatus for electrifying a surface of a photoreceptor with the use of an electrification member, the image forming apparatus comprising:

a first output unit configured to output a first AC voltage;

a second output unit configured to output a second AC voltage having the same frequency as a frequency of the first AC voltage and having a phase different from a phase of the first AC voltage;

a superimposition unit configured to superimpose, on a DC component, an AC component containing at least one of the first AC voltage and the second AC voltage; and an application unit configured to apply a voltage that has been subjected to superimposition by the superimposition unit to the electrification member, wherein the superimposition unit changes the AC component to be superimposed on the DC component at a predetermined timing.

2. The image forming apparatus according to claim 1, wherein the phase of the second AC voltage is opposite to the phase of the first AC voltage.

3. The image forming apparatus according to claim 2, wherein the superimposition unit switches the AC component to be superimposed between the first AC voltage and the second AC voltage.

4. The image forming apparatus according to claim 3, wherein the superimposition unit changes the AC component to be superimposed on the DC component among a first state in which an AC component containing the first AC voltage is superimposed on the DC component, a second state in which an AC component containing the second AC voltage is superimposed on the DC component, and a third state in which a voltage of 0 V obtained by combining the first and second AC voltages is superimposed on the DC voltage at a timing between the first state and the second state.

5. The image forming apparatus according to claim 1, wherein a frequency of an AC component of a developing voltage to be applied to a developing roller for developing an electrostatic latent image formed on the surface of the photoreceptor is an integral multiple of a frequency of each of the first and second AC voltages.

6. The image forming apparatus according to claim 1, wherein in a case where n is a natural number, the superimposition unit changes the AC component to be superimposed at an interval that is n times longer than a single period of the first and second AC voltages.

7. The image forming apparatus according to claim 6, wherein the superimposition unit has a plurality of different integral values as a value of n indicating the interval of change of the AC component to be superimposed.

8. The image forming apparatus according to claim 1, wherein a half period of each of the first and second AC voltages is equal to an integral multiple of a single period of an AC component of a developing voltage to be applied to a developing roller for developing an electrostatic latent image formed on the surface of the photoreceptor, and in a case where m is a natural number, the superimposition unit changes the AC component to be superimposed at an interval that is m times longer than the single period of the AC component of the developing voltage.

9. The image forming apparatus according to claim 8, wherein the superimposition unit has a plurality of different integral values as a value of m indicating the interval of change of the AC component to be superimposed.

10. The image forming apparatus according to claim 1, wherein the superimposition unit changes the AC component to be superimposed on the DC component at a timing determined on the basis of at least one of an image pattern, a system speed, and a frequency of an electrification voltage.

11. A non-transitory recording medium storing a computer readable program for controlling an image forming apparatus for electrifying a surface of a photoreceptor with the use of an electrification member, wherein the image forming apparatus includes a first output unit configured to output a first AC voltage and a second output unit configured to output a second AC voltage having the same frequency as a frequency of the first AC voltage and having a phase different from a phase of the first AC voltage, the program causes a computer to execute:

a superimposition step of superimposing, on a DC component, an AC component containing at least one of the first AC voltage and the second AC voltage; and an application step of applying a voltage that has been subjected to superimposition in the superimposition step to the electrification member, and in the superimposition step, the AC component to be superimposed on the DC component is changed at a predetermined timing.

12. The non-transitory recording medium storing a computer readable program for controlling an image forming apparatus according to claim 11, wherein the phase of the second AC voltage is opposite to the phase of the first AC voltage.

13. The non-transitory recording medium storing a computer readable program for controlling an image forming apparatus according to claim 12, wherein in the superimposition step, the AC component to be superimposed is switched between the first AC voltage and the second AC voltage.

14. The non-transitory recording medium storing a computer readable program for controlling an image forming apparatus according to claim 13, wherein in the superimposition step, the AC component to be superimposed on the DC component is changed among a first state in which an AC component containing the first AC voltage is superimposed on the DC component, a second state in which an AC component containing the second AC voltage is superimposed on the DC component, and a third state in which a voltage of 0 V obtained by combining the first and second AC voltages is superimposed on the DC voltage at a timing between the first state and the second state.

15. The non-transitory recording medium storing a computer readable program for controlling an image forming apparatus according to claim 11, wherein a frequency of an AC component of a developing voltage to be applied to a developing roller for developing an electrostatic latent image formed on the surface of the photoreceptor is an integral multiple of a frequency of each of the first and second AC voltages.

16. The non-transitory recording medium storing a computer readable program for controlling an image forming apparatus according to claim 11, wherein in the superimposition step, in a case where n is a natural number, the AC component to be superimposed is changed at an interval that is n times longer than a single period of the first and second AC voltages.

17. The non-transitory recording medium storing a computer readable program for controlling an image forming apparatus according to claim 16, wherein in the superimposition step, a plurality of different integral values is set as a value of n indicating the interval of change of the AC component to be superimposed.

18. The non-transitory recording medium storing a computer readable program for controlling an image forming apparatus according to claim 11, wherein a half period of each of the first and second AC voltages is equal to an integral multiple of a single period of an AC component of a developing voltage to be applied to a developing roller for developing an electrostatic latent image formed on the surface of the photoreceptor, and in the superimposition step, in a case where m is a natural number, the AC component to be superimposed is changed at an interval that is m times longer than the single period of the AC component of the developing voltage.

19. The non-transitory recording medium storing a computer readable program for controlling an image forming apparatus according to claim 18, wherein in the superimposition step, a plurality of different integral values is set as a value of m indicating the interval of change of the AC component to be superimposed.

20. The non-transitory recording medium storing a computer readable program for controlling an image forming apparatus according to claim 11, wherein in the superimposition step, the AC component to be superimposed on the DC component is changed at a timing determined on the basis of at least one of an image pattern, a system speed, and a frequency of an electrification voltage.

21. A method for controlling an image forming apparatus for electrifying a photoreceptor with the use of an electrification member, the image forming apparatus including a first output unit configured to output a first AC voltage and a second output unit configured to output a second AC voltage having the same frequency as a frequency of the first AC voltage and having a phase different from a phase of the first AC voltage, the method comprising:

a superimposition step of superimposing, on a DC component, an AC component containing at least one of the first AC voltage and the second AC voltage; and an application step of applying a voltage that has been subjected to superimposition in the superimposition step to the electrification member, wherein in the superimposition step, the AC component to be superimposed on the DC component is changed at a predetermined timing.

* * * * *